US010285432B2

(12) United States Patent
Williams et al.

(10) Patent No.: US 10,285,432 B2
(45) Date of Patent: May 14, 2019

(54) ROD FORMING APPARATUS AND METHOD

(71) Applicant: ALTRIA CLIENT SERVICES LLC, Richmond, VA (US)

(72) Inventors: Dwight David Williams, Powhatan, VA (US); Rosana C. Altoveros, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 287 days.

(21) Appl. No.: 15/212,973

(22) Filed: Jul. 18, 2016

(65) Prior Publication Data

US 2017/0013872 A1 Jan. 19, 2017

Related U.S. Application Data

(60) Provisional application No. 62/194,045, filed on Jul. 17, 2015.

(51) Int. Cl.
*A24C 3/00* (2006.01)
*A24C 1/36* (2006.01)
(Continued)

(52) U.S. Cl.
CPC ..... *A24C 3/00* (2013.01); *A24C 1/02* (2013.01); *A24C 1/18* (2013.01); *A24C 1/30* (2013.01); *A24C 1/34* (2013.01); *A24C 1/36* (2013.01); *A24C 1/38* (2013.01); *A24C 5/1807* (2013.01); *A24C 5/1871* (2013.01)

(58) Field of Classification Search
CPC ..... A24C 3/00
See application file for complete search history.

(56) References Cited

U.S. PATENT DOCUMENTS 2,952,262 A 9/1960 Pocock et al.
4,567,752 A 2/1986 Labbe
(Continued)

FOREIGN PATENT DOCUMENTS

EP 0081391 A2 6/1983
GB 2172491 A 9/1986

OTHER PUBLICATIONS

International Search Report and Written Opinion of the International Searching Authority; PCT/US2016/042814 dated Oct. 10, 2016.

*Primary Examiner* — Cynthia Szewczyk
(74) *Attorney, Agent, or Firm* — Harness, Dickey & Pierce P.L.C.

(57) ABSTRACT

A method of forming a wrapped article, comprising the steps of: forming a continuous stream of material such as an agricultural product; moving the continuous stream of material along an elongated path; compressing the continuous stream of material to reduce the cross-sectional area thereof until a predetermined cross-sectional dimension is achieved; drawing the compressed continuous stream of material through a rod-forming arrangement, the rod-forming arrangement having a non-contact displacement transducer associated therewith; folding at least one web longitudinally around the compressed continuous stream of material to form a continuous rod of material; and detecting variations in rod density within the rod-forming arrangement from a signal obtained from the non-contact displacement transducer.

21 Claims, 5 Drawing Sheets

(51) Int. Cl.

| | |
|---|---|
| ***A24C 1/02*** | (2006.01) |
| ***A24C 1/18*** | (2006.01) |
| ***A24C 1/30*** | (2006.01) |
| ***A24C 1/34*** | (2006.01) |
| ***A24C 1/38*** | (2006.01) |
| ***A24C 5/18*** | (2006.01) |

(56) References Cited

U.S. PATENT DOCUMENTS

| | | | | |
|---|---|---|---|---|
| 5,934,043 | A * | 8/1999 | Aindow ..... | A24C 5/473<br>53/371.4 |
| 2014/0048083 | A1 | 2/2014 | Williams et al. | |

* cited by examiner

ROD FORMING APPARATUS AND METHOD

FIELD

The present disclosure generally relates to tobacco rod formation in the manufacture of smoking articles, including cigar manufacturing and, in particular, to a method and apparatus for the formation of machine-made tobacco rods for use in the production of cigars.

ENVIRONMENT

In the manufacture of machine-made cigars, it is essential that tobacco be utilized as efficiently as possible due to its relatively high cost. In modern cigar manufacturing, it is also desirable to closely control the quantity of tobacco contained in each cigar, so as to provide a cigar that is considered well filled and is well filled on a consistent basis.

Tobacco utilization in the manufacture of machine-made cigars may be problematic with respect to certain tobacco blends. Machine-made cigars produced from pipe-tobacco blends have achieved wide acceptance in the market place. However, pipe-tobacco blends may have a degree of tackiness imparted thereto by the flavorants and other additives employed to enhance smoking enjoyment. It has been observed that the use of such tobacco, variations in moisture level, and other factors may give rise to variations in rod density, and other issues.

There is a need for an improved method and apparatus for the manufacture of tobacco products, including machine-made cigars from tacky tobaccos, which will provide satisfactory cigars of consistent draw, packing and rod density.

SUMMARY

In one aspect, provided is a method of forming a wrapped article, comprising the steps of forming a continuous stream of material such as an agricultural product; moving the continuous stream of material along an elongated path; compressing the continuous stream of material to reduce the cross-sectional area thereof until a predetermined cross-sectional dimension is achieved; drawing the compressed continuous stream of material through a rod-forming arrangement, the rod-forming arrangement having a non-contact displacement transducer associated therewith; folding at least one web longitudinally around the compressed continuous stream of material to form a continuous rod of material; and detecting variations in rod density within the rod-forming arrangement from a signal obtained from the non-contact displacement transducer.

In one form, the method further includes the steps of determining whether the variations in rod density exceed a predetermined limit; and rejecting wrapped article exceeding the predetermined limit.

In another form, the method further includes the steps of determining whether the variations in rod density exceed a predetermined limit; cutting the continuous rod of material; and rejecting individual wrapped articles exceeding the predetermined limit.

In yet another form, the rod-forming arrangement comprises a tongue, a short folder and a finishing folder.

In still yet another form, the non-contact displacement transducer is installed within the short folder.

In a further form, the non-contact displacement transducer is installed within the finishing folder.

In a still further form, the non-contact displacement transducer is an eddy-current sensor.

In a still yet further form, the agricultural product is selected from tobacco, reconstituted tobacco, tobacco substitutes or mixtures thereof.

In another form, the agricultural product comprises shredded tobacco.

In yet another form, the at least one web comprises a binder and a wrapper.

In another aspect, provided is an apparatus for the formation of machine-made tobacco rods, the apparatus comprising a conveyor for conveying a continuous stream of material comprising an agricultural product along an elongated path; a lower conveyor belt and an upper compression belt operative to receive and compress the continuous stream of material; a pair of squeeze bars operative to compress the tobacco in a direction transverse to said pair of transfer and compression belts; a rod-forming arrangement having a non-contact displacement transducer associated therewith, the rod-forming arrangement comprising a tongue operative to receive the compressed tobacco, and a folder for folding a wrapper material around the compressed tobacco so as to form a continuous rod of tobacco, wherein the output of the non-contact displacement transducer is used to detecting variations in rod density within the rod-forming arrangement.

In one form, the apparatus further includes a cutter for cutting the continuous rod of material into individual wrapped articles.

In another form, the apparatus further includes an ejector for ejecting individual wrapped articles having variations in rod density that exceed a predetermined limit.

In yet another form, the folder comprises a short folder and a finishing folder.

In still yet another form, the non-contact displacement transducer is installed within the short folder.

In a further form, the non-contact displacement transducer is installed within the finishing folder.

In a still further form, the non-contact displacement transducer is an eddy-current sensor.

In a still yet further form, the agricultural product is selected from tobacco, reconstituted tobacco, tobacco substitutes or mixtures thereof.

In another form, the agricultural product comprises shredded tobacco.

In yet another form, the apparatus further includes a tobacco feed section for providing a stream of tobacco in a substantially uniform format.

BRIEF DESCRIPTION OF THE DRAWINGS

The forms disclosed herein are illustrated by way of example, and not by way of limitation, in the figures of the accompanying drawings and in which like reference numerals refer to similar elements and in which.

DETAILED DESCRIPTION

Figure 1:
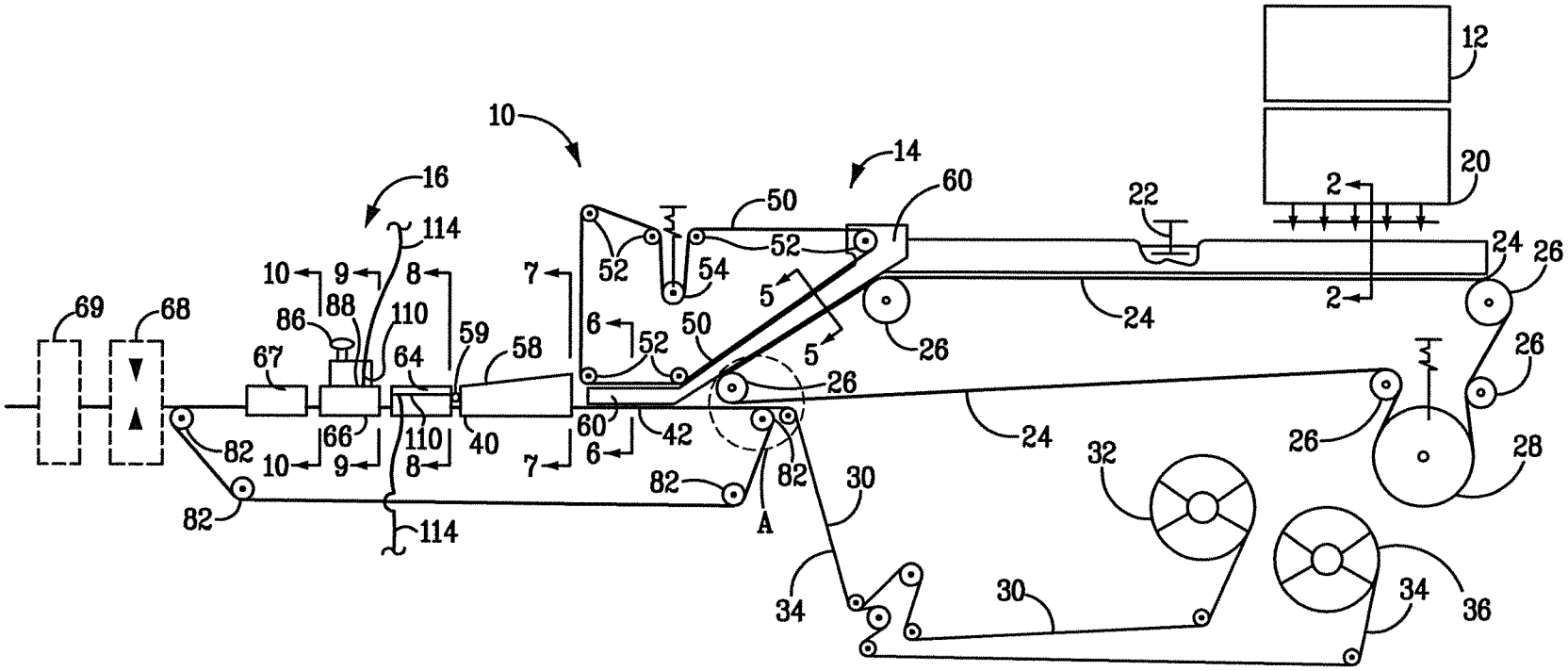
FIG. 1 schematically presents an apparatus for the formation of machine-made tobacco rods, in accordance herewith.

Various aspects will now be described with reference to specific forms selected for purposes of illustration. It will be appreciated that the spirit and scope of the apparatus, system and methods disclosed herein are not limited to the selected forms. Moreover, it is to be noted that the figures provided herein are not drawn to any particular proportion or scale, and that many variations can be made to the illustrated forms. Reference is now made to FIGS. 1-11, wherein like numerals are used to designate like elements throughout.

Each of the following terms written in singular grammatical form: "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms: "includes," "including," "has," "having," "comprises," and "comprising," and, their linguistic or grammatical variants, derivatives, and/or conjugates, as used herein, means "including, but not limited to."

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

As can be the case in the manufacture of certain machine-made smoking articles, such as cigars, the tobacco may comprise a tacky material combined therewith prior to or during rod formation, such as by way of addition of flavorants and other additives. Examples of suitable types of tobaccos that may be used in the manufacture of machine-made cigars include, but are not limited to, flue-cured tobacco, Burley tobacco, Maryland tobacco, Oriental tobacco, rare tobacco, specialty tobacco, reconstituted tobacco, blends thereof and the like. Optionally, the tobacco may be pasteurized. In the alternative, the tobacco material may be fermented.

Suitable flavorants and aromas include, but are not limited to, any natural or synthetic flavor or aroma, such as tobacco, smoke, menthol, mint (such as peppermint and spearmint), chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, and ginger oil. Other suitable flavors and aromas may include flavor compounds selected from the group consisting of an acid, an alcohol, an ester, an aldehyde, a ketone, a pyrazine, combinations or blends thereof and the like. Suitable flavor compounds may be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

Exemplary additional natural and artificial flavorants include, but are not limited to, peppermint, spearmint, wintergreen, menthol, cinnamon, chocolate, vanillin, licorice, clove, anise, sandalwood, geranium, rose oil, vanilla, lemon oil, cassia, fennel, ginger, ethylacetate, isoamylacetate, propylisobutyrate, isobutylbutyrate, ethylbutyrate, ethylvalerate, benzylformate, limonene, cymene, pinene, linalool, geraniol, citronellol, citral, orange oil, coriander oil, borneol, fruit extract, and the like. Particularly preferred additional flavor and aroma agents are essential oils and/or essences of coffee, tea, cacao, and mint.

Humectants can also be added to the tobacco material to help maintain the moisture levels. Examples of humectants that can be used with the tobacco include glycerol and propylene glycol. It is noted that the humectants can also be provided for a preservative effect, as the water activity of the product can be decreased with inclusion of a humectant, thus reducing opportunity for growth of micro-organisms. Additionally, humectants can be used to provide a higher moisture feel to a drier tobacco component.

In one form, the tobacco used in the manufacture of machine-made cigars employing the apparatus and methods disclosed herein is a pipe tobacco blend having a degree of tackiness imparted thereto.

Referring to FIG. 1, an apparatus 10 for the formation of machine-made tobacco rods is schematically presented. One such application is the production of cigars from a form of pipe tobacco.

As shown, the apparatus 10 includes a tobacco feed section 12, an in-feed section 14 and a finishing section 16. The tobacco feed section 12 may include at least one conveyer (not shown) for receiving a stream of tobacco from a source of tobacco. Tobacco feed section 12 may also include at least one electromagnetic vibrator (not shown) for providing the stream of tobacco in a substantially uniform format. Suitable electromagnetic vibrators are available from Eriez Corporation of Erie, Pa. and possess the ability provide for the relatively high speed feeding of light, bulky materials.

In one form, the in-feed section 12 may be constructed from existing equipment, such as an in-feed section of an AMF cigarette making machine. The finishing section 16 may also be constructed from existing equipment, such as a Molins Mk 8 or Mk 9 machine, available from Molins PLC of Milton Keynes, UK.

Referring still to FIG. 1, in one form, a vibratory waterfall feeder 20 is positioned downstream of the tobacco feed section 12 for receiving the stream of tobacco. The vibratory waterfall feeder 20 feeds tobacco to an in-feed section 14, establishing a column of tobacco along a lower conveyor belt 24, which is driven and guided by a plurality of pulleys 26. The lower conveyor belt 24 is kept in tension by a biased tension pulley 28. The stream of tobacco may optionally proceed past a trimmer unit 22, to establish a uniform height along the column of tobacco established atop the lower conveyor belt 24 by the vibratory waterfall feeder 20.

Figure 2:
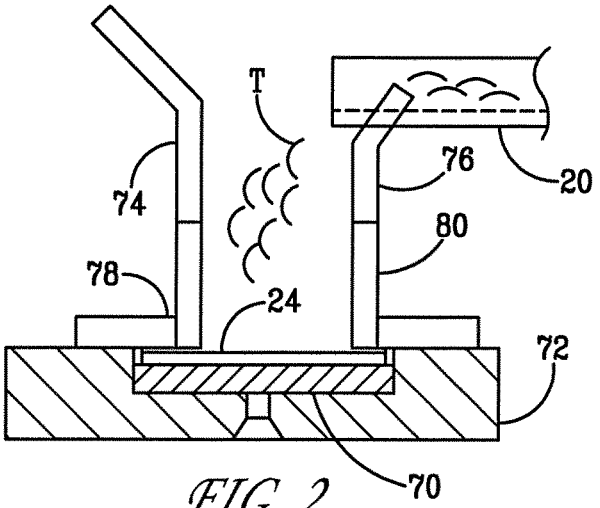
FIG. 2 is a cross-sectional view taken through section 2-2 of FIG. 1.

Referring now to FIG. 2, a view of the apparatus 10 taken through Section 2-2 is presented. As shown, a lower conveyor belt 24 rides above a conveyor guide 70, the conveyor guide 70 which may be positioned within a conveyer base plate 72. Tobacco T from the vibratory waterfall feeder 20 is deposited upon the lower conveyor belt 24. A first trough member 74 and a second, opposing, trough member 76, guide the tobacco T onto the lower conveyor belt 24. The first trough member 74 is affixed to a first angle bracket 78 and the second trough member 76 is affixed to a second angle bracket 80. As shown, the first angle bracket 78 and the second angle bracket 80 may extend over a portion of the lower conveyor belt 24 so as to maintain the position of the lower conveyor belt 24 within the conveyer base plate 72.

Referring again to FIG. 1, in one form, the in-feed section 14 includes an upper (compression) belt 50 positioned downstream of the vibratory waterfall feeder 20, above and in opposing relation with at least a portion of the lower conveyor belt 24 and is likewise disposed in an opposing relation with at least a portion of a transfer or garniture tube belt 42. The upper compression belt 50 and a portion of the garniture tube belt (or transfer belt) 42 are configured to receive and compress the stream of tobacco. The compression belt 50 may be driven and guided by a plurality of pulleys 52 and is kept in tension by a tension pulley 54.

Figure 3:
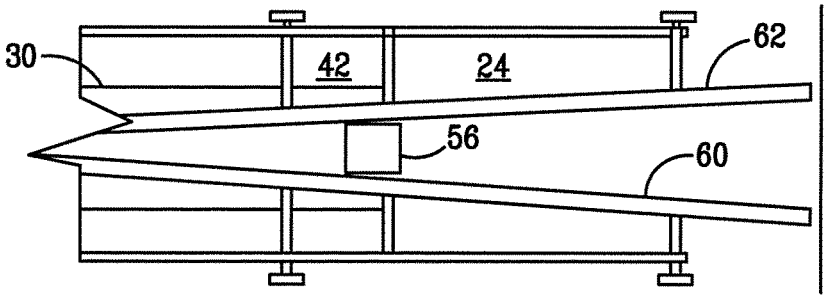
FIG. 3 schematically presents a top view of the in-feed section of an apparatus for the formation of machine-made tobacco rods, in accordance herewith.

Referring also to FIG. 3, squeeze bars 60 and 62 are provided in a mutually opposing, converging relation for compressing the tobacco in a transverse direction (side to side), while also the compression belt 50 and the lower conveyor belt 24 are in a mutually opposing, converging relation for compressing the tobacco from top to bottom of the tobacco column. At the furthest end of the lower conveyor belt 24, the tobacco column is transferred from the lower conveyor belt 24 onto a continuous ribbon of binder web 30, which is supplied from a source of binder web 32. The binder web 30 is mated with a wrapper web 34, which is supplied from a source of wrapper web 36, and is supported and drawn by a transfer or garniture tube belt 42. In some embodiments, the binder web 30 and the wrapper web 34 comprise tobacco.

Figure 4:
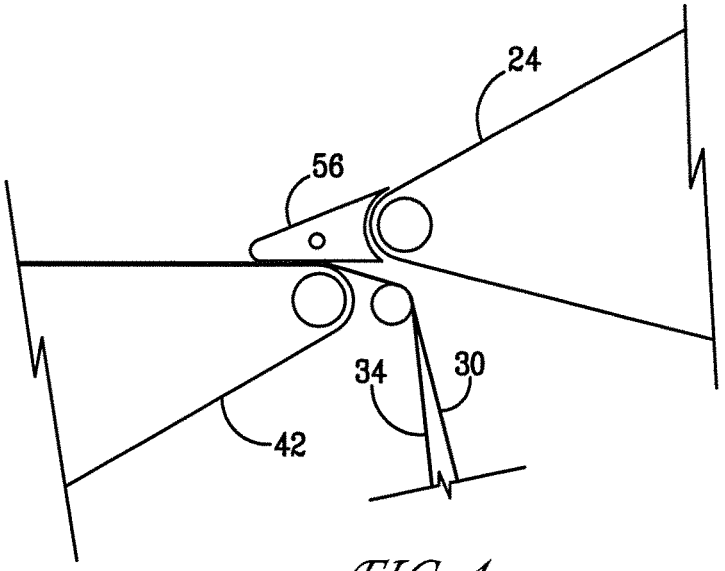
FIG. 4 presents an exploded view of Section A of FIG. 1.

Referring now to FIG. 4, an exploded schematic view of Section A of FIG. 1 is presented. As shown, in one form, a transition piece 56 is employed to bridge the transition from the lower conveyor belt 24 to the garniture tube belt 42, creating a smoother path for a tobacco column to traverse. Additionally, the transition piece 56 serves to reduce the level of turbulence that might otherwise be imparted to a tobacco column traversing the transition from the lower conveyor belt 24 to the garniture tube belt 42. The transition piece 56 occupies space at the transition between the belts 24 and 42, which space would otherwise allow tobacco to accumulate and intermittently release, which could impact product consistency.

Figure 5:
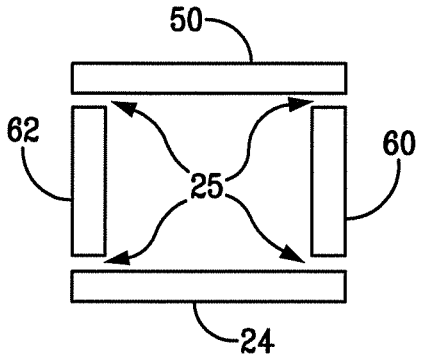
FIG. 5 is a cross-sectional view taken through Section 5-5 of FIG. 1.
Figure 6:
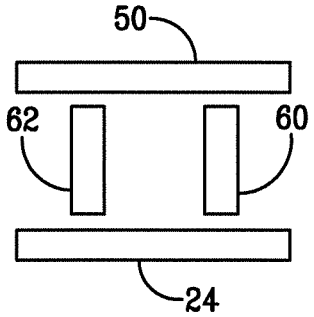
FIG. 6 is a cross-sectional view taken through Section 6-6 of FIG. 1.

Referring again to FIG. 1, the formation of the tobacco column will be described in more detail. As the tobacco stream enters the arrangement formed by the pair of squeeze bars 60 and 62, the lower conveyor belt 24, and the upper compression belt 50, the cross-sectional area of the arrangement is continuously reduced, forcing the tobacco to be compressed into an ever-smaller cross-section, until it reaches a desired cross-sectional dimension. Referring to FIG. 5, a cross-sectional view of Section 5-5 of FIG. 1 is presented. As may be seen, a cross-sectional-area is formed by the arrangement formed by the squeeze bars 60 and 62, the lower conveyor belt 24, and the upper compression belt 50. Moving along apparatus 10 to Section 6-6 of FIG. 1, reference is made to FIG. 6, wherein a reduced cross-sectional-area is depicted. As one of ordinary skill in the art would recognize small clearances or gaps exist along the corners 25 of the arrangement.

As the column of tobacco proceeds into the finishing section 16 it is drawn through a rod-forming arrangement 40, which includes a tongue 58. The rod-forming arrangement 40 is configured and arranged to fold the binder and the wrapper webs 30 and 34, respectively, longitudinally around the tobacco column and, in one form, employs a first garniture (or short folder) 64 and a second (or long or finishing folder) 66 for folding the wrapper web about the compressed tobacco column so as to form a continuous rod of tobacco suitable for use in the production of smoking articles, such as cigars, the wrapper web provided from a source of wrapper material. Second folder 66 is secured to the apparatus 10 by a folder clamp 88, which may be adjusted using clamp adjusting screw 86.

An adhesive, which may be an adhesive such as PVA, is applied by an adhesive applicator 59 to one lap edge of the wrapper web 34, and seals the lap joint by applying heat, by at least one heater 67 to set the adhesive.

Figure 7:
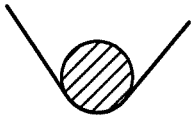
FIGS. 7-10 present cross-sectional views of a tobacco rod as it progresses through the folding (or rolling) operation.
Figure 8:
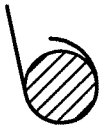
Figure 9:
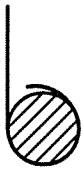
Figure 10:
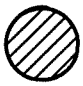

To further demonstrate the folding or rolling operation, reference is made to FIG. 1 and to FIGS. 8-11, where cross-sections of a tobacco rod are presented to show the relative state of wrapper/binder folding or rolling at various positions along the length of the rod-forming arrangement 40. As shown in FIG. 7, taken at Section 7-7 of FIG. 1 at the entrance to the tongue 63, the folding process has yet to begin. As shown in FIG. 8, taken at Section 8-8 of FIG. 1 at the entrance to the short folder 64, the folding operation has begun, with an upper lap edge of the wrapper/binder 30/34 extending substantially vertically and having had an application of glue applied thereto by the adhesive applicator 59. Referring now to FIG. 9, taken at Section 9-9 of FIG. 1 at the entrance to the second folder 66, it may be seen that one side of the wrapper/binder 30/34 has been fully rolled over, while the upper lap edge of the wrapper/binder 30/34 still extends substantially vertically. Referring now to FIG. 10, taken at Section 10-10 of FIG. 1 at the exit of the second folder 66, it may be seen that the tobacco rod has been fully formed and ready for heating to set the glue applied by the adhesive applicator 67.

A continuous rod is thus produced and is carried by the garniture tube belt 42 through an optional air bearing arrangement (not shown). The rod then emerges from the garniture tube belt 42 and may pass through a weight scanner (not shown) and then through a diameter gauge (not shown) before being cut into discrete rod lengths by a cutter 68.

In the formation of tobacco rods, such as machine-made cigars, it is desirable to produce rods with uniform packing and cross-section, devoid of hard spots of tobacco that could give rise to partial plugging or excessive variations in draw. As indicated above, in the case of the manufacture of certain machine-made smoking articles, such as cigars, the tobacco may comprise a tacky material combined therewith prior to or during rod formation, such as by way of addition of flavorants and other additives. The use of such tobacco may, in some circumstances, serve to increase the possibility of plugging or excessive variations in draw.

To assist in the manufacture of uniform rods, whether filled with tobacco, filter material or another material or materials, provided herein is a system that integrates non-contact sensor technology with rod formation technology to achieve that end.

Referring again to FIG. 1, a rod-forming arrangement 40 is provided with one or more non-contact displacement transducer(s) 110 associated therewith. As indicated above, the rod-forming arrangement 40 comprising a tongue 58 operative to receive the compressed tobacco, and at least one folder for folding a wrapper material around the compressed tobacco so as to form a continuous rod of tobacco. In some embodiments, the at least one folder comprises a first (short) folder 64 and a second (finishing or long) folder 66.

As will be described below, the output of the non-contact displacement transducer 110 is used to detect variations in rod density within the rod-forming arrangement 40. In some embodiments, the apparatus 10 includes an ejector 69 for ejecting individual wrapped articles having variations in rod density that exceed a predetermined limit, in response to the output of the non-contact displacement transducer 110.

In some embodiments, the first (or short) folder 64 and folder clamp 88 may be equipped with non-contact displacement transducers 110 to detect changes in component displacement brought about by changes in pressure in the respective areas resulting from the amount of tobacco contained in a cross-section of a tobacco rod being processed. A typical or baseline measurement may be established at the beginning of each run to calibrate the non-contact displacement transducers 110 to the particular tobacco being used. Spikes in displacement may be used to identify hard spots of tobacco coming through the system due to irregularities in the incoming blends and normal variations in the feed from the vibratory waterfall feeder 20.

Figure 11:
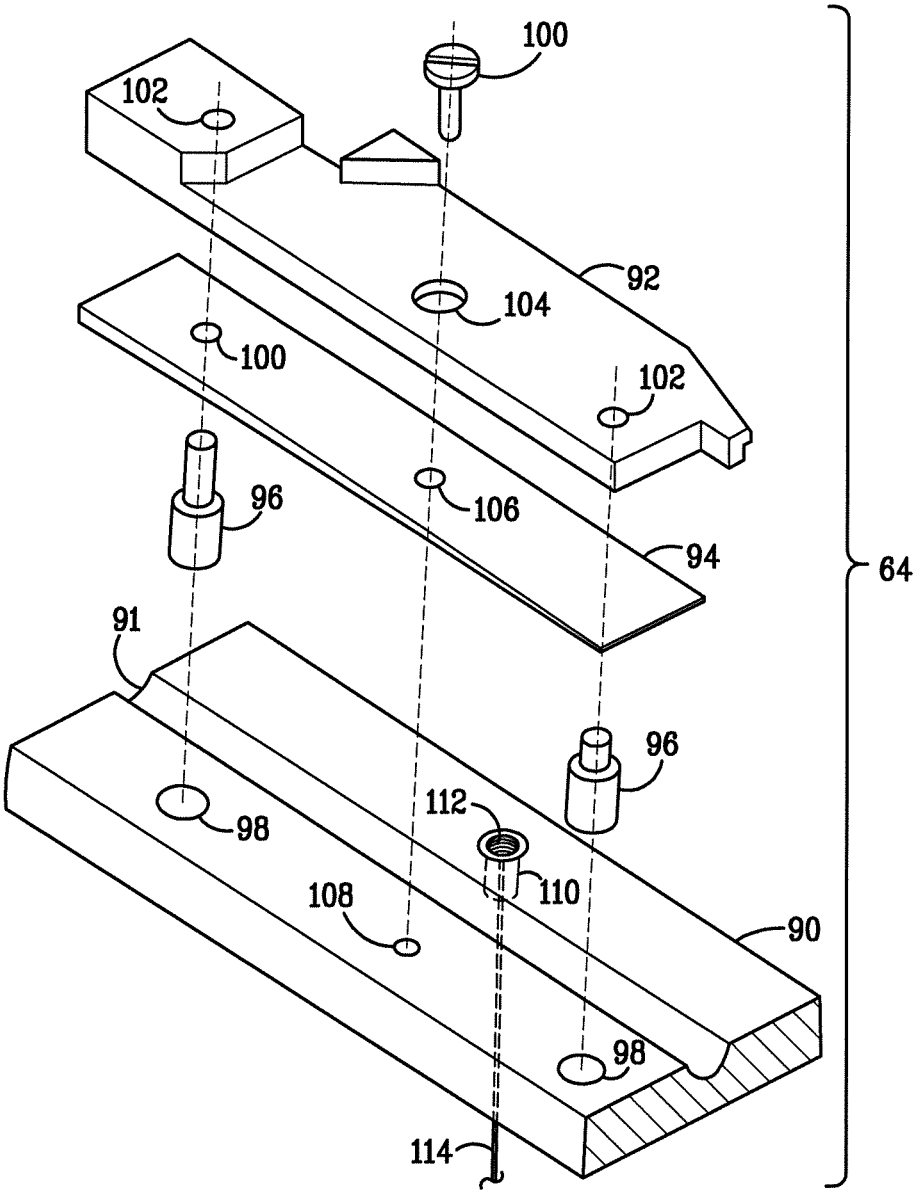
FIG. 11 presents an exploded view of a short folder, in accordance herewith.

Referring now to FIG. 11, an exploded view of a first (or short) folder 64 is shown. The short folder includes a base 90, having a rod-forming trough 91. As may be appreciated, since the height of the tobacco rod being formed should be less at the exit of the short folder 64 than at the entry, a wedge 94 having a fixed slope may be employed. The wedge 94 is positioned upon the base 90, and an upper folder portion 92 positioned above the wedge 94. To maintain the position of the components of short folder 64, dowel pins 96 are positioned within base holes 98, wedge hole 100 and upper member holes 102. Securing screw 100, which may be a countersunk screw, passes through wedge hole 106 and engage base hole 108, to maintain the integrity of the short folder 64.

To detect variations in rod density within the short folder 64 of rod-forming arrangement 40, a non-contact displacement transducer 110 may be installed in mounting hole 112 of the base 90 of short folder 64. Alternatively, a non-contact displacement transducer 110 may be installed in upper folder portion 92. Leads 114 of non-contact displacement transducer 110 may transfer the output of the non-contact displacement transducer 110 to a controller having suitable signal conditioning and processing means, which may be used to control one or more machine functions to remedy operations or eject product outside of specification for rod variation.

Referring again to FIG. 1, one or more additional non-contact displacement transducers 110 may be installed within rod-forming arrangement 40. In some embodiments, a non-contact displacement transducer 110 may be installed in the second (finishing or long) folder 66. In some embodiments, this non-contact displacement transducer 110 may be installed in folder clamp 88.

In some embodiments, the entry side of the folder may be held in place by a steel dowel pin and screw. The exit side of the folders may have a toe-clamp with a fairly thin cross section. The toe-clamp holds the exit end of the folder securely enough to produce a quality rod, while still possessing enough flex to allow the exit end of the folder to move slightly when the pressure increases in the garniture. This movement, or pressure increase, is used to detect hard and soft spots in the rod, such that the non-contact displacement transducer 110 picks up movement caused by the exit end of the folder flexing.

In some embodiments, non-contact displacement transducer 110 is an eddy-current sensor. As those skilled in the art will recognize, eddy current displacement sensors are one form of non-contact industrial measurement technology and are used to measure displacement, deformation, stretching, distances, position and other geometrical shapes and sizes of any electrically conductive target.

The eddy current principle is used in applications with measurements on electrically conducting materials that may have ferromagnetic or non-ferromagnetic properties. A high-frequency alternating current is passed through a coil built in to the sensor housing. The electromagnetic field of the coil induces eddy currents in the conducting measurement object, whereby the resulting impedance of the coil changes. This change in impedance causes an electrical signal that is proportional to the distance of the measurement object to the sensor coil. Eddy current sensors are well suited for applications where harsh industrial environments caused by pressure, dust and temperature exist.

Certain eddy current sensors use a wound coil, while others embed the sensor itself in an inorganic carrier material so that the electronic components can be positioned on the carrier material itself. This enhances the ability to handle more extreme temperatures and improves long-term stability, as well as excellent repeatability.

Suitable eddy-current sensors may be obtained from Micro-Epsilon of Raleigh, N.C. USA.

In one form, the apparatus 10 employs a programmable logic controller (PLC unit) to control the formation of machine-made tobacco rods. Suitable PLC units are available from a number of sources, including Allen-Bradley, a division of Rockwell Automation of Milwaukee, Wis. An eddy-current sensor signal may be fed to the PLC unit to detect variations in rod density within the rod-forming arrangement 40. As indicated above, in some embodiments, the apparatus 10 includes an ejector 69 for ejecting individual wrapped articles having variations in rod density that exceed a predetermined limit, in response to the output of the eddy-current sensor signal.

Various other signals, which may include the vibratory waterfall feeder 20, may be fed to the PLC unit. These signals may be used, for example, to control a metering belt (not shown) which may be adjusted proportionally to the rod-making speed by signals received by the PLC unit. In one form, there is a sensor provided to monitor rod-making speed and the PLC unit is programmed to dynamically adjust the metering belt in response to changes in rod-making speed.

Other signals that may be monitored and fed to the PLC unit include an indication of the tobacco temperature obtained from a temperature sensor that may be located in a tobacco hopper, or in the chamber near the trimmer. Suitable rod diameter gauges may also be employed, such as those described in U.S. Pat. No. 2,952,262, the contents of which are hereby incorporated by reference for such details.

In operation, a tobacco column is carried on the gravity conveyor 24 and drawn by the lower and upper belts 24 and 50, respectively. between the squeeze bars 60 and 62 to the garniture tube belt 42. A signal indicative of the firmness of the finished rod may be used to control the trimmer height preferably after correction to compensate for moisture variations so that the trimmer is controlled in response to the "dry firmness." A control motor may drive the trimmer up and down around an average trimmer height $H_{avg}$, in response to control signals from the microprocessor 66. The actual height H of the trimmer, determined by a trimmer position sensor (not shown), is fed to the PLC unit to provide a signal corresponding to the actual resistance of the part of the filler column that remains after trimming.

From the data received, the PLC unit may calculate characteristics of the finished product and display such information on a display unit. PLC unit and display unit may be housed within a cabinet, which may also include a control panel, the combination of which forms a control system. The control panel may provide the ability to control various functions, including the heaters, glue applicator, machine start-up, system power, etc. Suitable control systems may be obtained from Jewett Automation of Richmond, Va. In one form, control system is a Jewett Automation Model Q75.

Alternatively, or in addition, information can be fed to a central management control system either for instant display or for storage, or for both.

Additionally details concerning process controls and control schemes useful in the operation and control of apparatus 10 are provided in U.S. Pat. No. 4,567,752, the contents of which are hereby incorporated by reference in their entirety.

Also disclosed herein is a method of forming a wrapped article. The method includes forming a continuous stream of material comprising an agricultural product; moving the continuous stream of material along an elongated path; compressing the continuous stream of material to reduce the cross-sectional area thereof until a predetermined cross-sectional dimension is achieved; drawing the compressed continuous stream of material through a rod-forming arrangement, the rod-forming arrangement having a non-contact displacement transducer associated therewith; folding at least one web longitudinally around the compressed continuous stream of material to form a continuous rod of material; and detecting variations in rod density within the rod-forming arrangement from a signal obtained from the non-contact displacement transducer.

In some embodiments, the method includes determining whether the variations in rod density exceed a predetermined limit and rejecting wrapped article exceeding the predetermined limit. In some embodiments, the method includes first cutting the continuous rod of material, then rejecting individual wrapped articles exceeding the predetermined limit.

In some embodiments the non-contact displacement transducer is installed within the short folder. In some embodiments the non-contact displacement transducer is installed within the finishing folder. In some embodiments, non-contact displacement transducers are installed in both the short folder and the finishing folder. In some embodiments, the non-contact displacement transducer is an eddy-current sensor.

In some embodiments, the agricultural product is selected from tobacco, reconstituted tobacco, tobacco substitutes or mixtures thereof. In some embodiments, the agricultural product comprises shredded tobacco. The method of claim 1, wherein the at least one web comprises a binder and a wrapper.

The advantages of the systems and methods disclosed herein are simplicity of installation, low level of intrusiveness to existing design, low maintenance, low cost to maintain and install, and the ability to detect variations in rod density where moisture levels are varying substantially. As may be appreciated, current microwave technologies have limited success due to the high variation in rod moisture. Also, since the tobacco may be sticky causing flavors to adhere to surfaces, the non-contact approach is desirable. The systems and methods disclosed herein also have utility in the manufacture of cigarette filters, especially where carbon, carbon on tow, and flavor bead detection is required.

While the present inventions have been described in connection with a number of exemplary forms, and implementations, the present inventions are not so limited, but rather cover various modifications, and equivalent arrangements, which fall within the purview of the present claims. For example, it is contemplated that the subject matter disclosed herein would have utility in the formation of any wrapped or formed body produced from a tacky shredded material, such as shredded herbal material, pouches of tacky shredded material, moist snuff or the like.

What is claimed:

1. A method of forming a wrapped article, comprising:
- forming a continuous stream of material;
- moving the continuous stream of material along an elongated path;
- compressing the continuous stream of material to reduce a cross-sectional area thereof until a cross-sectional dimension is achieved;
- drawing the compressed continuous stream of material through a rod-forming arrangement;
- folding, with a folder, at least one web longitudinally around the compressed continuous stream of material to form a continuous rod of material, the folder having a non-contact displacement transducer disposed therein;
- measuring folder displacement with the non-contact displacement transducer; and
- detecting variations in density of the continuous rod of material within the rod-forming arrangement based on an output from the non-contact displacement transducer.

2. The method of claim 1, further comprising:
- determining whether the variation in density exceeds a desired limit;
- cutting the continuous rod of material to form a wrapped article; and
- rejecting the wrapped article if the variation exceeds the desired limit.

3. The method of claim 1, wherein the rod-forming arrangement comprises a tongue, the folder, and an additional folder.

4. The method of claim 3, wherein the folder is a short folder.

5. The method of claim 3, wherein the folder is a finishing folder.

6. The method of claim 3, wherein the folder is a short folder, and the additional folder is a finishing folder.

7. The method of claim 1, wherein the non-contact displacement transducer is an eddy-current sensor.

8. The method of claim 1, wherein the material includes tobacco, reconstituted tobacco, tobacco substitute, a sub-combination thereof, or a combination thereof.

9. The method of claim 1, wherein the material includes shredded tobacco.

10. The method of claim 1, wherein the at least one web includes a binder, a wrapper, or both the binder and the wrapper.

11. The method of claim 1, wherein the folder displacement includes displacement in the folder.

12. An apparatus, the apparatus comprising:

a conveyor configured to transport a continuous stream of material along an elongated path;

an upper compression belt and a pair of squeeze bars configured to compress the continuous stream of material; and a rod-forming arrangement including, a tongue configured to-receive the compressed continuous stream of material, and a folder configured to fold a wrapper material around the compressed continuous stream of material so as to form a continuous rod of material, the folder having a non-contact displacement transducer for measuring folder displacement.

13. The apparatus of claim 12, further comprising:

a cutter configured to cut the continuous rod of material into individual wrapped articles.

14. The apparatus of claim 12, further comprising:

a cutter configured to cut the continuous rod of material into individual wrapped articles;

a controller configured to detect variations in rod density from an output of the non-contact displacement transducer and identify articles of the individual wrapped articles having variations in rod density that exceed a limit; and an ejector configured to eject the articles of the individual wrapped articles having variations in rod density that exceed the limit.

15. The apparatus of claim 12, wherein the folder includes a short folder.

16. The apparatus of claim 15, wherein the folder is a finishing folder.

17. The apparatus of claim 12, wherein the non-contact displacement transducer is an eddy-current sensor.

18. The apparatus of claim 12, wherein the material includes tobacco, reconstituted tobacco, a tobacco substitute, a sub-combination thereof, or a combination thereof.

19. The apparatus of claim 12, wherein the material comprises shredded tobacco.

20. The apparatus of claim 12, further comprising:

a feed section configured to provide a stream of material to form the continuous stream of material.

21. The apparatus of claim 12, wherein the folder displacement includes displacement in the folder.

* * * * *